United States Patent [19]

Adler et al.

[11] 3,934,162

[45] Jan. 20, 1976

[54] MINIATURIZED NUCLEAR BATTERY

[75] Inventors: Karl Adler, Grenchen; Georges Ducommun, Feldbrunnen, both of Switzerland

[73] Assignee: Biviator, S.A., Grenchen, Switzerland

[22] Filed: May 15, 1973

[21] Appl. No.: 360,565

[30] Foreign Application Priority Data

May 26, 1972 Switzerland ..... 7798/72

[52] U.S. Cl. ..... 310/3 A; 310/30; 136/202

[51] Int. Cl. ..... G21d 7/00

[58] Field of Search ..... 310/3 A, 3 D; 136/202; 58/23 BA

[56] References Cited

UNITED STATES PATENTS

| | | | |
|---|---|---|---|
| 2,930,909 | 3/1960 | Lirb | 310/3 D |
| 3,706,893 | 12/1972 | Olsen et al. | 310/3 B |

FOREIGN PATENTS OR APPLICATIONS

| | | | |
|---|---|---|---|
| 735,847 | 8/1955 | United Kingdom | 310/3 D |

OTHER PUBLICATIONS

"General Physics Section Progress Report," Isotopic Battery in the uW–Range, 1970, pp. 63–82, Aktiebelaget Atomanegi (Sweden).

*Primary Examiner*—Maynard R. Wilbur
*Assistant Examiner*—N. Moskowitz
*Attorney, Agent, or Firm*—Imirie, Smiley & Linn

[57] ABSTRACT

The present invention relates to a miniaturized nuclear battery, consisting of several in series connected cells, wherein each cell contains a support which acts as positive pole and which supports on one side a $\beta$-emitter, above said emitter is a radiation resisting insulation layer which is covered by an absorption layer, above which is a collector layer, and wherein the in series connected cells are disposed in an airtight case.

27 Claims, 1 Drawing Figure

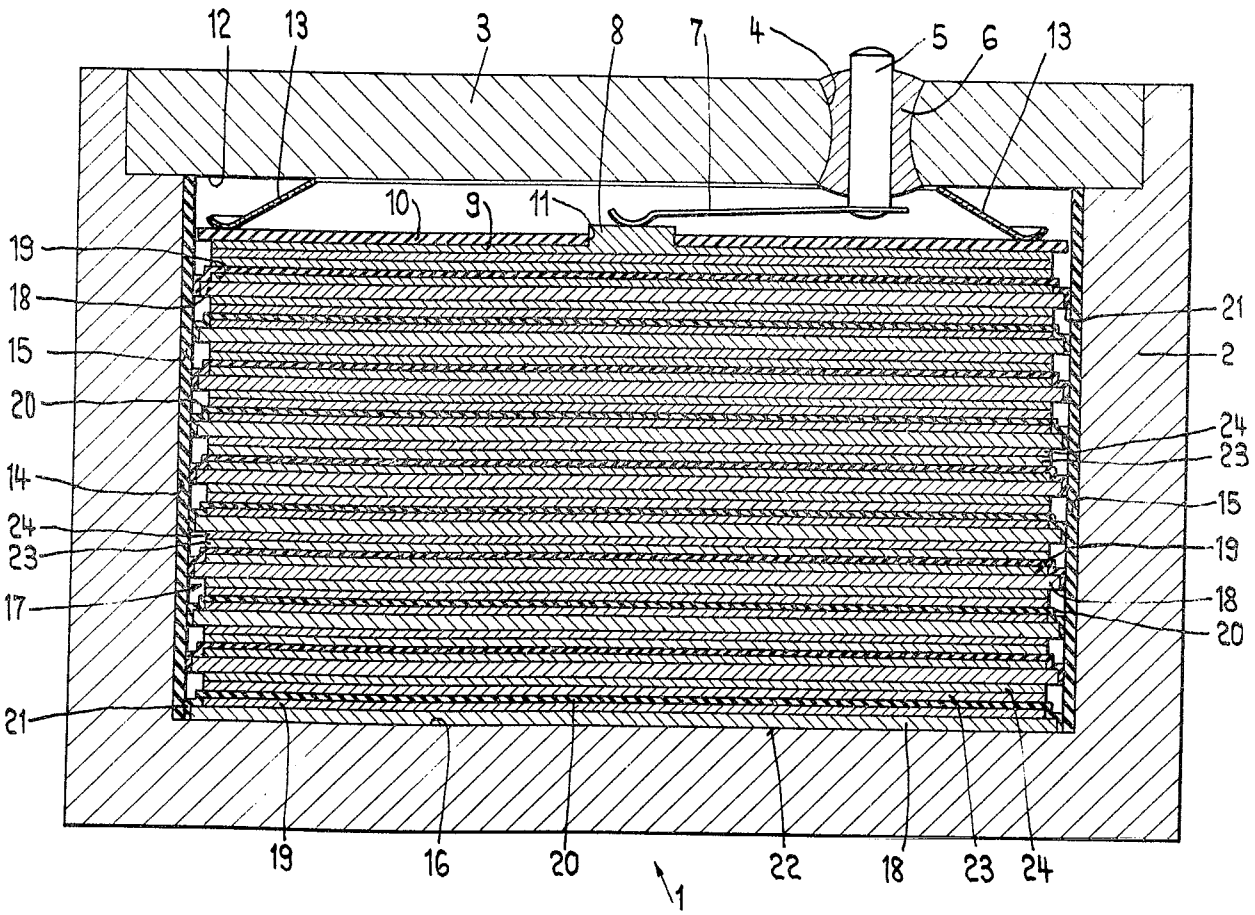
21
2
24
23
15
19
18
20
13
6
5
4
7
8
11
3
9
10
13
12
24
23
18
22
1
20
16
19
19
18
15
20
14
24
23
17
21

MINIATURIZED NUCLEAR BATTERY

BACKGROUND OF THE INVENTION

This invention relates to a miniaturized nuclear battery, composed of several cells mounted in series.

Such sources of electricity are needed, so that electrically driven apparatus, as for example electric or electronic watches, can operate without interruption caused by the periodic replacing of the batteries.

Batteries as mentioned above are already known, but satisfying results could not be obtained for a miniaturized nuclear battery, fulfilling all conditions relative to security, a life of 10 to 20 years, and an appropriate output power.

In particular such batteries are known which contain higher energetic $\beta$-sources as Sr 90, Pm 147, etc. For safety reasons such batteries are not suited for uncontrolled use.

Because of the limited intensity of the radiation for safety and in particular because of its half-life of 12.5 years, tritium (T or $^3H$) appeared to be singularly suited as a source of radiation, in spite of the fact that only vacuum could be used as dielectric medium. This is a disadvantage vis-a-vis the mentioned higher energetic $\beta$-sources, as they could have allowed a solid, and thus a more dense dielectric with a half-value-thickness for these emitters far above the 40 mg/cm$^2$ for tritium. Due to the medium intensity of radiation of about 6 keV of the tritium, batteries with this source are only feasible with vacuum as dielectric. Although by more recent embodiments of such batteries the freed helium no longer lowers the vacuum in a short time, there exist no results wherein a vacuum of $10^{-3}$ Torr is maintained as long as the life of the battery lasts, without losses.

Another drawback of the vacuum battery turns up when a satisfying amount of current has to be furnished, which has to be done by increasing the flow of electrons to the collector and that means, as the surface activity has to be limited, an increase of the total surface. This is reached by a special arrangement of the emitter surface, which increases the volume of the battery. For the application of such batteries in miniaturized devices as for example watches, hearing aids, pace-makers, etc., the dimensions play an eminent role, often tenths of millimeters are most important.

An impedance matching of such batteries to the devices to be supplied is very difficult as their no-load voltage corresponds practically to the mean radiation energy of tritium. With a matched load, $U_{eff}$ is still 2–3 kV.

SUMMARY OF THE INVENTION

The aim of the present invention is to provide for a miniaturized nuclear battery which eliminates the disadvantages of the vacuum battery with tritium and the difficulties of the impedance matching, and which has a solid dielectric medium. The battery should have a terminal voltage of about 500 V.

This problem is solved according to the invention in that each cell contains a support-element which acts as positive pole and which supports on one side a $\beta$-emitter, above said emitter is a radiation resisting insulation layer which is covered by an absorption layer above which is a collector layer, and that the in series connected cells are put in an airtight case.

In an advantageous modification of the invention the cells lay superimposed in the case.

The advantages reside in particular in that although several cells with a weak radiation intensity are used, a relatively great radiation intensity per unit surface can be realized, so that the total power output of the nuclear battery becomes high. It is further possible to make the emitter film on the support-element so thin, that even the electrons of the lowest layer can penetrate to the surface and are not already absorbed by the emitter film. The absorption layer above the insulation layer prevents the creation of a counter-field by electrons reflected from the collector.

An example of an embodiment of the invention is shown in the drawing and will be described more in detail.

BRIEF DESCRIPTION OF THE DRAWING

The sole FIGURE shows schematically and in section the construction of one embodiment according to the present invention.

DESCRIPTION OF THE PREFERRED EMBODIMENT

In the FIGURE the case 1 consists of a cup-shaped base 2 and a flat lid 3. The lid 3 is welded to the base 2. It has an opening 4 in which a contact pole 5 is cast-in with a casting compound 6. At its interior end this contact pole 5 has a contact spring 7, which connects pole 5 with a protrusion 8 of a contact disc 9. Above disc 9 is an insulating disc 10 with an opening 11, through which the raised part 8 of disc 9 protrudes. A pressure spring 13 is located between the lower side 12 of the lid and the insulating disc 10. The inner lateral surfaces 14 of case 1 are covered by an electric insulating and radiation resisting insulation layer 15. Particulary well suited as, insulating materials are synthetic material films, for example "Parylene" (registered trademark), consisting of a group of polymers, or of polyester, "Mylar"(registered trademark), or the like.

The said case 1 can of course be constructed otherwise, if the following points are considered:

The case must be airtight. It must have a contact pole 5 which is electrically insulated from base 2 and lid 3 and which is electrically connected to the collector of the top cell, the latter being described later. It is important that the cells be held strongly avoiding electric contacting of parts to be isolated with the case or another conducting part.

Between the bottom of base 2 and contact disc 9 are piled up several identical cells 17. In this example there are 10. Each of those 10 cells 17 consists of a support-element 18, for example of copper or a Cr-Ni- alloy. Other metallic materials are possible, too. Said support 18 has advantageously a surface which matches that of the bottom 16. Its thickness is some microns, by realized prototypes about $1–3\times10^{-2}$ mm, whereas the surface was about 2 cm$^2$.

On this support is a $\beta$-emitter 19 with a somewhat smaller surface, as an evaporated or otherwise deposed film. Preferentially said $\beta$-emitter consists of a tritium-titanium-compound, subsequently called Ti-T- compound, in the ratio of one part titanium and two parts tritium. This film has a thickness which is enough to generate an activity of about 40 mC/cm$^2$ and amounts to 0.5 – 1 G2zm.

Said film of radioactive material is covered by a radiation resisting insulation layer 20, which reaches advantageously over the sides 21 of support 18, so that only the lower side 22 of it remains uncovered. In order to warrant a maximum efficiency of cell 17 the insulation layer 20 must be so thin that the electrons which are emitted from the $\beta$-emitter 19 with a mean energy of 0.5 – 6.0 keV can pass without obstruction. It has been found that a film of "Parylene" or "Mylar" with a thickness of $1\times10^{-4}$ mm is convenient.

Above the insulation layer 20 is an absorption layer 23, which prevents reflected electrons from the overlaying collector 24 from penetrating again the insulation layer 20. Said layer 23, which consists advantageously of carbon with a thickness of about $1\times10^{-2}$ mm has further the task to bind the helium which is freed by the decay. The surface of the layer 23 matches approximately that of the $\beta$-emitter 19 and is thus a little smaller than that of the support 18. As top layer of each cell 17, the collector layer 24 is above the absorption layer and has a surface area which matches that of the absorption film. Preferentially the collector layer is made of Al, Fe or an alloy of these substances, and has a thickness of $1 - 2\times10^{-2}$ mm.

As mentioned above, there are several such cells piled up, with support 18 of each succeeding cell disposed atop the collector of the subjacent cell.

Each of the cells 17, which in this example is circular in plan, has a total thickness of about $3\times10^{-2}$ mm, and an activity of nearly 40 mC, and generates a power of approximately 0.012G2zW under a potential of 50 V. That means that the battery in the example with 10 in series connected cells has an effective activity of about 400 mC, a power of nearly 0.12G2zW, and a voltage of nearly 500 V.

According to the construction of the cells, with respect to the flow of the electrons, base 2 forms the positive pole and contact pole 5 forms the negative pole of the battery.

Thus this battery fulfills all demanded requirements. Nevertheless for particular applications its power may be too low. It is then quite easy to increase the total power output by connecting in parallel several batteries, of course put in one case. Due to the smallness of the individual cells, the overall volume of such a battery is practically not modified. It has, in connection with this, to be borne in mind that the proportions of the drawing are distorted, to allow a better understanding of the invention.

In the following the physical properties of the nuclear battery according to the invention and those of conventional vacuum batteries are compared.

In order to obtain a useful quantity of electrons an effective activity of 240 mC is needed. The total activity, which is needed in a vacuum battery for such an effective activity is about 5 C, which can easily be calculated from known physical constants. A vacuum battery with an optimum efficiency has under these conditions a no-load voltage of about 3000 V, whereas the no-load power is about 6 G2zW. Because such a high voltage is not useful, an impedance matching has to be effectuated. To be able to compare, let the vacuum battery have an effective voltage $U_{eff}$ of 500 V. With an optimum impedance matching an effective output power of the battery of about 0.75 G2zW can be obtained.

As mentioned above, a battery with 10 in series connected cells of 40 mC and 50 V has a terminal voltage of about 500 V and a total effective activity of about 400 mC. It has to be mentioned that the effective activity of 40 mC per cell is obtained with only 100 mC total activity due to the extremely thin emitter film.

This means that 10 such cells have a total activity of about 1 C with an output power of 0.12 G2zW, and further that with the same total activity as with the vacuum battery, 5 C, five packages of 10 cells each, which can easily be parallel-connected, can produce an effective output power of 0.6 G2zW under 500 V. It should be mentioned that in practice the theoretical maximum impedance matching of the vacuum battery cannot be obtained. In general the output of a vacuum battery with a no-load voltage of 3000 V and a no-load power of 6 G2zW will not exceed 0.6 G2zW under 500 V. On the contrary the battery according to the invention needs no impedance matching, the output voltage being 500 V, so that the output power of the above described battery is effectively 0.6 G2zW under 500 V. It means that the efficiency of both types of battery is practically identical, that is with a total activity of 5 C an effective output power of 0.6 G2zW is generated. Nevertheless it is important to note that the battery according to the invention does not have the drawbacks of the vacuum battery and is substantially smaller than the latter.

It is obvious that the battery depending on the application can have another relationship between the in series connected cells and that the surface of each cell can be varied too.

The case of the battery may be also directly a component of the device operated by the battery.

What we claim is:

1. A nuclear battery comprising a plurality of in series connected, superposed cells, each cell including a generally flat support element acting as a positive pole, a $\beta$-emitter supported on one side of said support element, a radiation resisting insulation layer disposed on said support layer and completely overlying said $\beta$-emitter, an absorption layer atop said insulation layer, and a collector layer atop said absorption layer, wherein the support element of each superposed cell lies directly on the collector layer of its subjacent cell without space between them and the in series connected cells are disposed in an airtight case where a compact battery is obtained.

2. A nuclear battery according to claim 1, wherein said support element is made of a copper- or a Cr-Ni-disc.

3. A nuclear battery according to claim 1, wherein said $\beta$-emitter is made of a Ti-T-compound.

4. A nuclear battery according to claim 1, wherein said radiation resisting insulation layer consists of a synthetic material made of polyester or polymer groups.

5. A nuclear battery according to claim 1, wherein said absorption layer is made of carbon.

6. A nuclear battery according to claim 1, wherein said collector layer is made of Fe,Al or an alloy of these substances.

7. A nuclear battery according to claim 1, wherein said cells are circular in plan.

8. A nuclear battery according to claim 1, wherein each cell has a thickness of about 30 G2zm.

9. A nuclear battery according to claim 1, wherein each cell generates voltage of about 50 V.

10. A nuclear battery according to claim 1, wherein the output power of a cell is about 0.012 G2zW.

11. A nuclear battery according to claim 1, wherein the cells are piled up in the case.

12. A nuclear battery according to claim 1, wherein said case consists of a cup-shaped base and a thereon welded flat lid.

13. A nuclear battery according to claim 1, wherein said case acts as the positive pole of the battery.

14. A nuclear battery according to claim 1, wherein case (1) contains 10 cells.

15. A nuclear battery according to claim 2, wherein the copper disc has a thickness of $1 - 2\times10^{-2}$ mm.

16. A nuclear battery according to claim 3, wherein the Ti-T-compound consists of one part titanium and two parts tritium.

17. A nuclear battery according to claim 16, wherein said Ti-T-compound forms a film with an activity of about 40 mC.

18. A nuclear battery according to claim 4, wherein the insulation layer has a thickness of about $1\times10^{-4}$ mm.

19. A nuclear battery according to claim 5, wherein said carbon layer has a thickness of about $1\times10^{-2}$ mm.

20. A nuclear battery according to claim 6, wherein said collector layer has a thickness of about $1 - 2\times10^{-2}$ mm.

21. A nuclear battery according to claim 7, wherein each cell has an effective surface of about 2 $cm^2$.

22. A nuclear battery according to claim 11, wherein above the top cell is a contact disc with a raised part, said part protruding through an insulating disc.

23. A nuclear battery according to claim 12, wherein the inner surfaces of the side wall of the base have an insulation layer thereon.

24. A nuclear battery according to claim 12, wherein said lid has a cast-in contact pole.

25. A nuclear battery according to claim 22, wherein a spring is put between the lid and the insulation disc.

26. A nuclear battery according to claim 24, wherein the contact pole and the raised part are electrically connected.

27. A nuclear battery according to claim 26, wherein said contact pole acts as negative pole.

* * * * *

UNITED STATES PATENT OFFICE

CERTIFICATE OF CORRECTION

PATENT NO. : 3,934,162

DATED : January 20, 1976

INVENTOR(S) : Karl Adler et al

It is certified that error appears in the above-identified patent and that said Letters Patent are hereby corrected as shown below:

Column 2, line 65, "G2zm" should be -- $\mu$m--.

Column 3, lines 29, 32, 58 and 63; Column 4, lines 4, 8, 13, 17 and 20, each occurrence, "G2zW" should be -- $\mu$W--.

Claim 8, line 2, "G2zm" should be -- $\mu$m--.

Claim 10, line 2, "G2zW" should be -- $\mu$W--.

Signed and Sealed this

Second Day of November 1976

[SEAL]

*Attest:*

RUTH C. MASON
*Attesting Officer*

C. MARSHALL DANN
*Commissioner of Patents and Trademarks*